US005113626A

United States Patent [19]

Seider et al.

[11] Patent Number: 5,113,626

[45] Date of Patent: May 19, 1992

[54] EARTH ANCHOR APPARATUS HAVING IMPROVED LOAD BEARING ELEMENT

[75] Inventors: Gary L. Seider; Daniel V. Hamilton, both of Centralia, Mo.

[73] Assignee: A.B. Chance Company, Centralia, Mo.

[21] Appl. No.: 535,765

[22] Filed: Jun. 11, 1990

[51] Int. Cl.[5] ..... C02D 5/80

[52] U.S. Cl. ..... 52/157; 175/394; 175/395

[58] Field of Search ..... 52/157; 175/394, 395

[56] References Cited

U.S. PATENT DOCUMENTS

| | | | |
|---|---|---|---|
| 810,807 | 1/1906 | Pitcher . | |
| 1,388,031 | 8/1921 | Dray | 52/157 |
| 1,883,477 | 10/1932 | Bash . | |
| 1,940,938 | 12/1933 | Chance | 52/157 |
| 1,960,639 | 5/1934 | Kuhn . | |
| 2,343,350 | 3/1944 | Warren . | |
| 3,076,532 | 2/1963 | Frye . | |
| 3,645,055 | 2/1972 | Roza | 52/157 |
| 4,316,350 | 2/1982 | Watson | 52/157 |

FOREIGN PATENT DOCUMENTS

| | | | |
|---|---|---|---|
| 0596694 | 3/1978 | U.S.S.R. | 52/157 |

*Primary Examiner*—Richard E. Chilcot, Jr.
*Assistant Examiner*—Lynn E. Wood
*Attorney, Agent, or Firm*—Hovey, Williams, Timmons & Collins

[57] ABSTRACT

An earth anchor apparatus includes a hub having a longitudinal axis and first and second axial ends, and a load-bearing helix affixed to the hub. The load-bearing helix includes a generally radially extending leading edge adjacent the first end of the hub, a generally radially extending trailing edge adjacent the second end of the hub, an inner circumferential section connected to the hub, and an outer circumferential section extending radially outward from the inner circumferential section and having an outer circumferential edge separated from the inner section. A pair of opposed surfaces extend between the inner section and the outer edge and define a thickness of the helix. The thickness of the helix at the trailing edge is greater adjacent the inner circumferential section than at the outer circumferential edge, and the thickness of the helix adjacent the inner circumferential section is greater at the trailing edge of the helix than at the leading edge. In this manner, material is removed from areas of the helix where less loading stress develops during installation and use of the anchor while materials is added to areas of higher loading stress.

4 Claims, 2 Drawing Sheets

EARTH ANCHOR APPARATUS HAVING IMPROVED LOAD BEARING ELEMENT

BACKGROUND OF THE INVENTION

1. Field of the Invention

The present invention relates generally to earth anchors and, more particularly, to an earth anchor having a load-bearing helix shaped to compensate for relatively high loading stresses which occur adjacent a trailing edge of the helix during installation and use of the anchor.

2. Discussion of the Prior Art

It is known, e.g. from U.S. Pat. No. 4,316,350, issued to Watson on Feb. 22,1982, to provide an anchor with a load-bearing element in the form of an anchoring spiral which extends radially outward from a central body of the anchor by an amount which varies in the circumferential direction of the spiral between a lead point of the anchor and a trailing segment of the spiral.

In such constructions, it is further known to provide the spiral with a thickness which is constant across the radial extent of the spiral, but which increases in the circumferential direction of the spiral between a minimum thickness adjacent the lead point of the anchor and a maximum thickness at a trailing point of the spiral.

Although it is possible to increase the strength of an anchor by increasing the thickness of the load-bearing element in such a uniform manner, the use of a thickened element increases the weight of the anchor as well as the amount of material required to construct it. Accordingly, it would be beneficial to construct an anchor having a load-bearing element which is thickened only in the region where the load experienced by the anchor is at a maximum, while providing a reduced thickness in areas where loads of smaller magnitude are carried.

Earth anchors of conventional type are typically used to provide anchoring against a tensile load such as a utility pole or the like which is to be supported above the ground and retained against falling in a direction away from the anchor. When employed in this manner, an anchor is generally subjected to a tensile load which is believed to exert a substantially uniform pressure on the upper surface of the load-bearing element, i.e. the surface facing the object exerting the load on the anchor.

In the past, it has been a belief by some practitioners in the art of designing earth anchors that when such a uniform pressure is experienced by the upper surface of an earth anchor having a helix which extends around almost the entire circumference of the anchor, the location on the load-bearing element of highest stress is or should be immediately opposite the leading and trailing edge of the load-bearing element.

This theory is based upon consideration of the effect of such a uniform pressure on a generally C-shaped, annular flat plate having a radial cut-out portion extending completely through the plate. When such a plate is attached to an interior hub and a surface of the plate is loaded with a uniform pressure, failure of the plate would be expected to occur along a radial line located immediately opposite the radial cut since it is along this line that the least surface area of the plate exists to resist the load.

However, the present inventors have found that the predicted effect of failure occurring opposite the trailing or leading edge does not occur, and that by properly locating the actual point of high load stress on the load-bearing helix, an anchor may be locally strengthened to withstand a desired predetermined load limit.

OBJECTS AND SUMMARY OF THE INVENTION

Accordingly, it is an object of the present invention to provide an earth anchor having a load-bearing element shaped to compensate for relatively high loading stresses which the inventors have found to occur adjacent a trailing edge of the load-bearing element near the point of intersection between the trailing edge and the hub.

Further, it is an object of the invention to provide an earth anchor having a construction which assists in preventing bending or failure of a trailing edge of a load-bearing element in order to avoid detrimental effects created by such bending of the element. Other objects will become evident from the detailed description of a preferred embodiment of the invention as well as from a review of the attached drawing figures.

The construction of the present invention was developed only after it was discovered by the inventors, by uncovering anchors which had been intentionally submitted to a tensile load greater than that which the anchors were capable of supporting, that failure of the anchors occurred at the trailing edge of the load-bearing element in a region immediately adjacent the point of intersection between the trailing edge of the load-bearing element and the hub of the anchor. This observation made of actual anchors was confirmed through computer analysis of a simplified configuration of conventional anchors, the analysis illustrating that when a uniform load was exerted on the upper surface of a helical load-bearing element of the type employed in conventional earth anchors, the highest stress experienced by the load-bearing element occurred at the point of intersection between the trailing edge of the load-bearing element and the hub.

In addition to considering the effect of a uniform pressure on the upper surface of the load-bearing helix, the inventors also considered the effect of point loading a trailing tip of the helix in order to determine the location of maximum stress on the helix when such loading occurs. Again, it was determined that the point of maximum load stress experienced by the helix occurred at the point of intersection between the trailing edge and the hub.

In view of these observations and conclusions, the inventors developed an earth anchor construction addressing the need for additional strength in the region surrounding the point of intersection between the trailing edge of the load-bearing helix and the hub. Other needs were also addressed which will become evident from a review of the disclosure of the preferred embodiment of the invention.

In accordance with one aspect of the invention, an earth anchor apparatus includes a hub having a longitudinal axis and first and second axial ends, and a load-bearing helix affixed to the hub. The load-bearing helix includes a generally radially extending leading edge adjacent the first end of the hub, a generally radially extending trailing edge adjacent the second end of the hub, an inner circumferential section connected to the hub, and an outer circumferential section extending radially outward from the inner circumferential section and having an outer circumferential edge separated from the inner section.

Further, a pair of opposed surfaces extend between the inner section and the outer edge of the helix and define the thickness of the helix. The thickness of the helix at the trailing edge is greater adjacent the inner circumferential section of the helix than at the outer circumferential edge, and the thickness adjacent the inner circumferential section of the helix is greater at the trailing edge than at the leading edge.

By providing this construction, numerous advantageous results are realized. For example, by providing the helix with a thickness which is greater within a radially inner region of the helix adjacent the trailing edge than elsewhere on the helix, an earth anchor is obtained which possesses increased strength in the area of the point of intersection between the trailing edge of the helix and the hub. Further, by removing material from the remaining areas of the helix, or by providing such areas with less material, a savings in material used in the anchor is achieved without an attendant loss of overall strength of the anchor.

Additional features of the inventive construction further add to the strength characteristics of the anchor. For example, the thickness of the helix at the trailing edge may be tapered from the inner section toward the outer circumferential edge to give the helix a uniform shape, or the thickness adjacent the inner circumferential section may be made to decrease in the circumferential direction of the helix within a region extending at least 90 degrees around the helix from the trailing edge.

Further, the inner circumferential section may include a generally curved surface extending between the hub and each of the opposed surfaces, wherein each of the curved surfaces defines a first radius adjacent the trailing edge of the helix and a second radius adjacent the leading edge of the helix, the first radius being greater than the second radius.

BRIEF DESCRIPTION OF THE DRAWING FIGURES

A preferred embodiment of the inventive earth anchor is described in detail below with reference to the attached drawing figures, wherein.

DETAILED DESCRIPTION OF A PREFERRED EMBODIMENT

Figure 1:
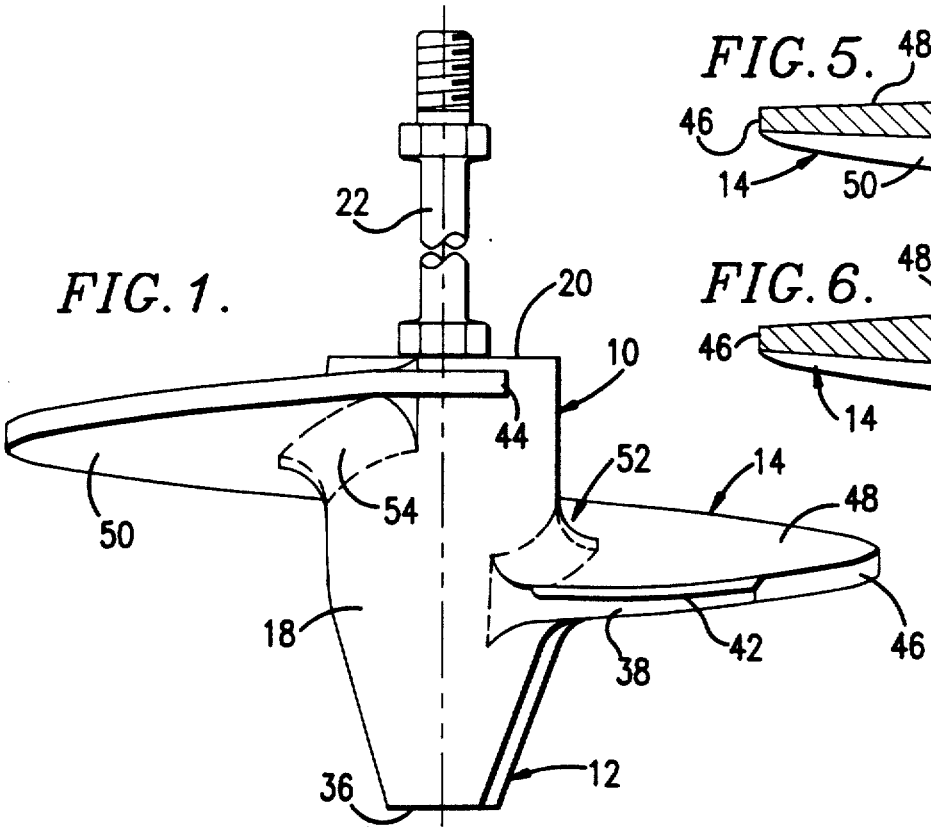
FIG. 1 is a front elevation view of an earth anchor constructed in accordance with the present invention, and an elongated rod adapted to be attached to the anchor.

An earth anchor constructed in accordance with a preferred embodiment of the invention is illustrated in FIG. 1, and includes a hub 10, a lead point 12 extending from one axial end of the hub, and a load-bearing element 14 in the form of a helix extending radially outward from the hub.

The hub 10 includes a longitudinal axis 16 and includes two axial ends 18, 20. As mentioned, the lead point 12 of the anchor extends axially from one of the axial ends 18. The other axial end 20 is adapted to be connected, via a threaded connection or the like such as that shown in FIG. 3, to an elongated rod 22 capable of carrying a load once the anchor is installed to a desired depth beneath the surface of the soil.

Figure 2:
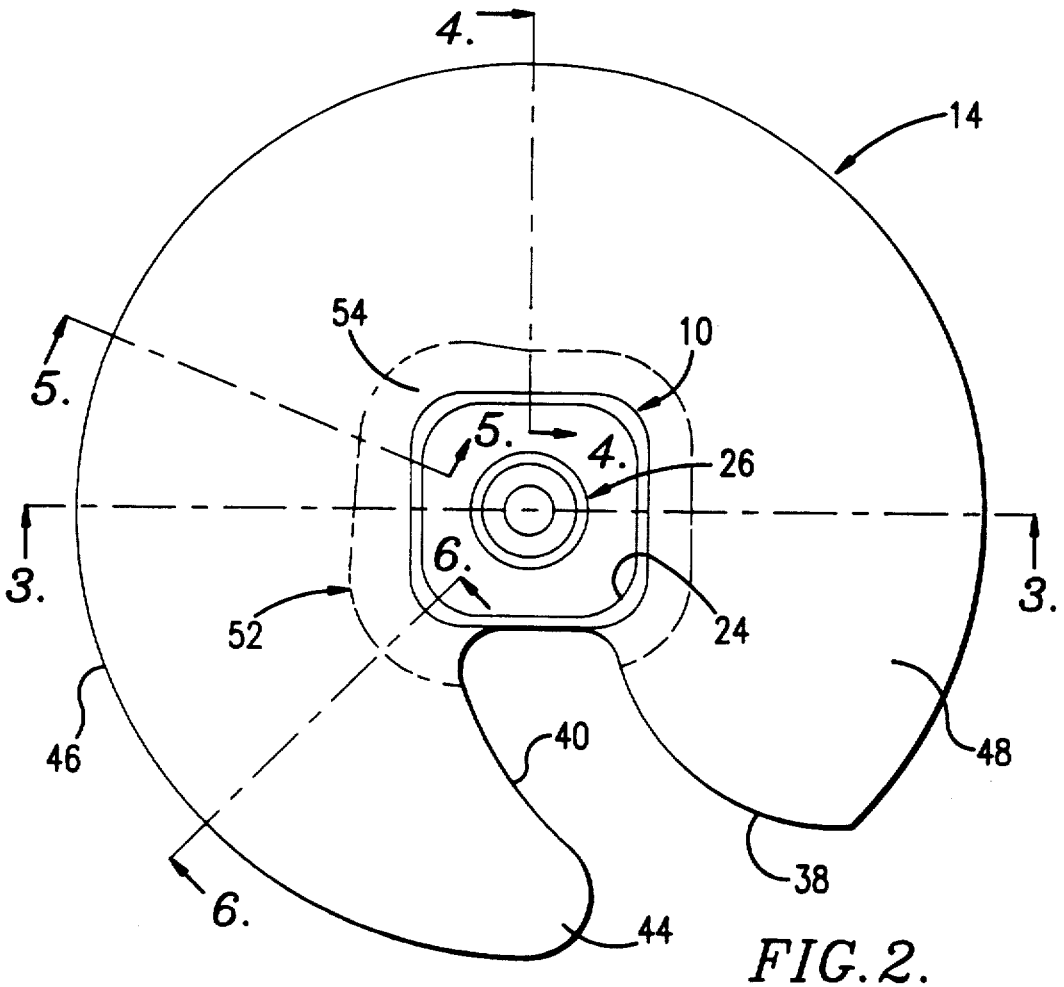
FIG. 2 is a top plan view of the earth anchor.

As shown in FIG. 2, the hub 10 includes a cavity 24 having a non-circular shape when viewed in a plane transverse to the longitudinal axis. By forming the hub 10 with a cavity of this shape, it is possible to insert a wrench (not shown) having a cooperating shape into the hub and to turn the wrench about the longitudinal axis in order to screw the anchor into the soil. When viewing FIG. 2, the anchor must be turned in the clockwise direction during such installation.

Figure 3:
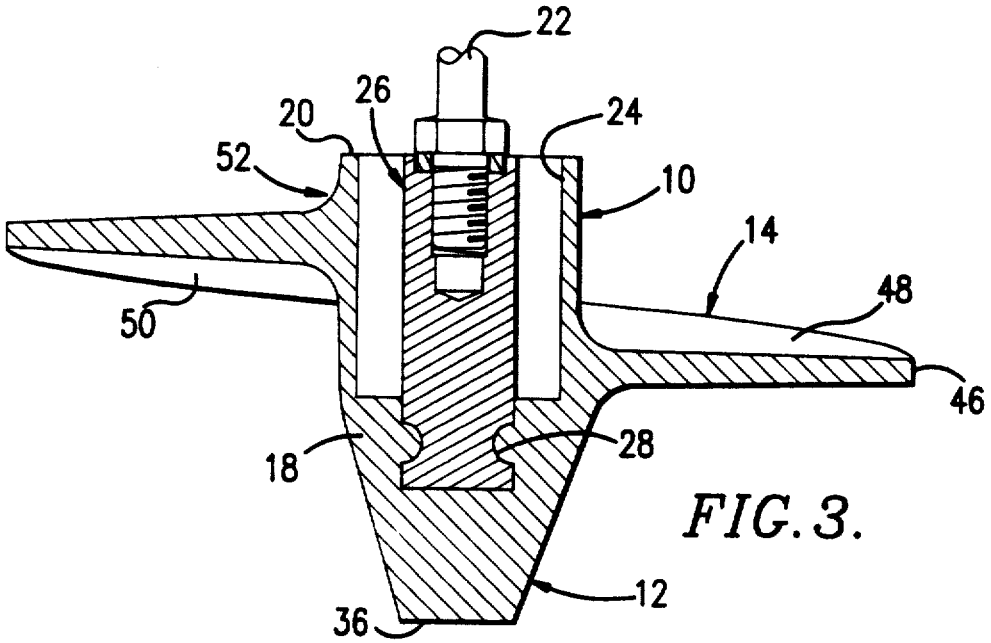
FIG. 3 is a vertical sectional view taken along line 3—3 of FIG. 2.

The cavity 24 is also shown in FIG. 3, and extends circumferentially around an insert 26 which is connected to the anchor during construction thereof. The insert 26 is preferably constructed of a hot rolled steel and preferably is formed of a steel such as AISI No. C 1035 steel of standard bar quality. However, it is possible to form the insert 26 of other known materials or to form the insert of the same material as the remainder of the anchor. The insert 26 is provided with a threaded opening in the exposed axial end thereof for receiving the elongated rod, and may include an annular groove 28 adjacent the end thereof which is embedded in the anchor material. This groove 28 insures a reliable fit between the insert and the anchor during formation of the anchor.

Figure 7:
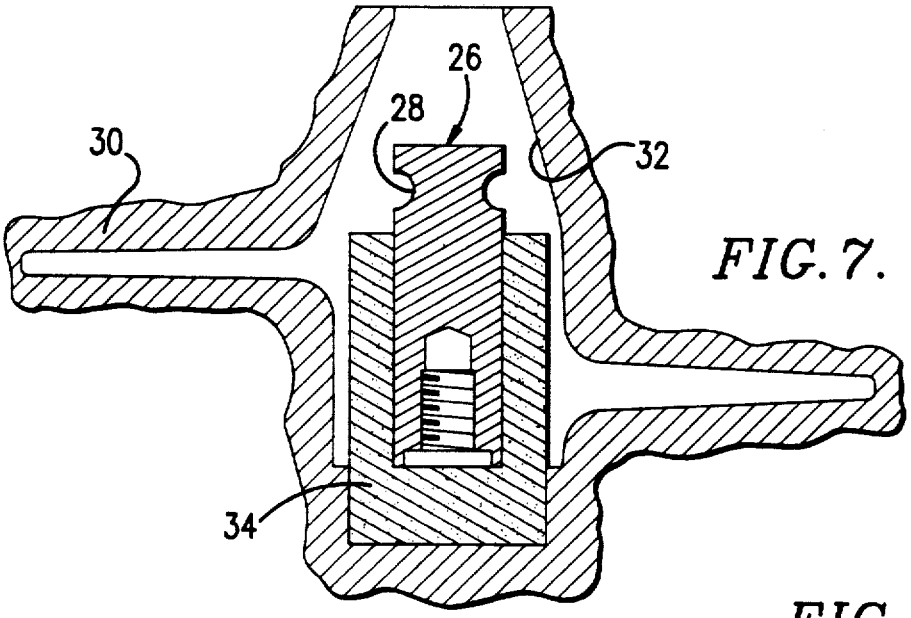
FIG. 7 is a sectional view of a mold, an insert and a sand core for use in casting an earth anchor.

A mold 30 is illustrated in FIG. 7, which is used to construct the earth anchor of the preferred embodiment. The mold 30 defines a cavity 32 in the shape of the anchor to be formed therein, and room is provided for receiving a sand core 34. The core 34 positions the insert 26 relative to the cavity 32 so that when the anchor material is cast, the material surrounds and becomes connected to the axial end of the insert which includes the annular groove 28. After molding, the sand core 34 is removed leaving a space defining the cavity 24 of the finished anchor.

The preferred material for use in the anchor is a medium carbon steel such as a Grade 70-36[485-250] steel. However, one of skill in the art will recognize that other materials may also be used in the anchor.

Returning to FIG. 1, the lead point 12 is shown as including an axially extending protruding tip 36 adapted to break the soil immediately beneath the hub 10 during installation of the anchor and to move broken soil radially outward toward the load-bearing helix 14. By providing such a tip, the anchor is capable of passing through the soil without the hub 10 becoming caught-upon unbroken soil and impending the movement of the anchor into the ground. An example of a preferred lead point 12 construction for use in relatively high strength anchors is disclosed in U.S. patent application Ser. No. 451,215, filed Dec. 15, 1989, by Platz and assigned to the assignee of the present invention. A copy of the specification of this referenced application is submitted herewith as appendix A.

The helical load-bearing element 14 includes a single piece of material and is unitary with the hub when the anchor is cast in the mold as shown in FIG. 7. The helix 14 extends in the circumferential direction of the hub 10 between a generally radial leading edge 38, shown in FIG. 2, to a trailing edge 40 which also extends radially outward from the hub 10. The leading edge 38 of the helix may be provided with a cutting edge 42 for improving penetration of the anchor into soils, and the trailing edge 40 preferably tapers off to a trailing tip 44.

The helix 14 includes a predetermined constant pitch sufficient to provide a desired lift of the anchor during installation while preventing reverse rotation or removal of the anchor through the soil when the anchor is loaded with a tensile load. The helix 14 further includes a generally constant diameter such that a substantially circular outer circumferential edge 46 is defined which extends between the leading and trailing edges 38, 40 of the helix.

An upper surface 48 of the helix 14 is defined by the surface facing the axial end 20 of the hub 10 at which the elongated rod 22 is attached such that when a tensile load is exerted on the anchor through the rod, pressure is exerted on the upper surface 48 of the helix 14. This upper surface 48 opposes a lower surface 50 which is separated from the upper surface by a distance defining the thickness of the helix 14. This thickness is not constant, but rather is varied in dependence upon the stress expected to be experienced at different locations on the helix 14 during loading.

For example, because it has been observed that anchors loaded beyond their capacity frequently fail at the point of intersection between the trailing edge 40 of the helix 14 and the hub 10, an anchor in accordance with the present invention is provided with additional material in the vicinity of this point. Of course, it would not be advantageous to thicken the helix 14 at only this point, with a sharp drop in the thickness of the helix immediately adjacent the point of intersection. Such sharp changes in the thickness of the load-bearing helix 14 would create weak spots in the helix thus serving only to move the point of failure from the point of intersection between the trailing edge 40 and the hub 10 to the point of intersection between the thickened region and the remainder of the helix 14.

Figure 6:
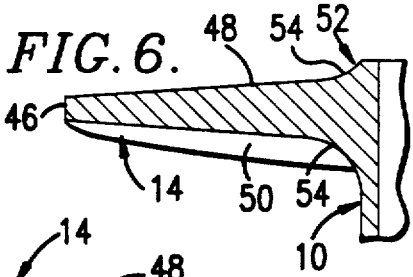
FIG. 6 is a vertical sectional view taken along line 6—6 of FIG. 2.

Accordingly, in the preferred embodiment, the helix 14 is provided with a thickened region adjacent the point of intersection between the trailing edge 40 and the hub 10, and gradually tapers off to a relatively smaller thickness in both the radial and circumferential directions of the helix 14 so that a smooth transition between the thickened region and the remainder of the helix is provided. For example, the thickness of the helix 14 at the trailing edge 40 should decrease in the radial direction of the helix within a region extending at least about one-half the distance from the hub 10 toward the outer circumferential edge 46, and preferably decreases in the radial direction within a region extending substantially the entire distance between the inner section and the outer circumferential edge. This gradual decrease in the thickness of the helix between the hub 10 and the outer circumferential edge 38 at the trailing edge 40 is shown in FIG. 6.

Figure 4:
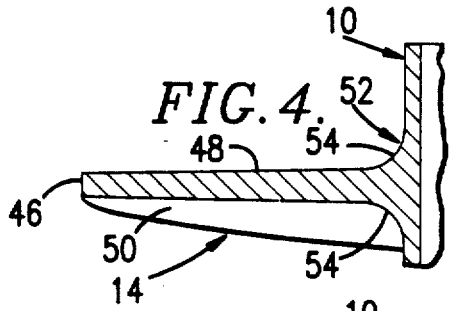
FIG. 4 is a vertical sectional view taken along line 4—4 of FIG. 2.
Figure 5:
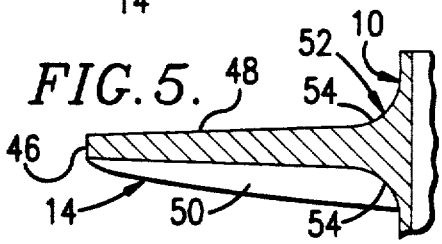
FIG. 5 is a vertical sectional view taken along line 5—5 of FIG. 2.

In addition to being tapered in the radial direction, the helix 14 is also tapered in the circumferential direction about the hub 10. For example, the thickness of the helix 14 adjacent the hub 10 should decrease in the circumferential direction of the helix within a region extending at least 90 degrees around the helix from the trailing edge 40, and preferably decreases within a region extending about 180 degrees around the helix from the trailing edge. Additionally, as the thickness of the helix 14 adjacent the hub 10 decreases, the amount of tapering in the radial direction of the helix also decreases such that the helix becomes gradually more flat in the circumferential direction extending from the trailing edge 40 toward the leading edge 38. This tapering of the thickness of the helix both in the radial and circumferential directions is shown in FIGS. 4–6, which illustrate the thickness of the helix at various angular positions around the hub 10. By tapering the helix 14 in this manner, material is added in the region adjacent the critical point of load stress while being left off of the helix in areas where higher strength is not needed.

As shown in FIG. 1, the helix 14 is also provided with an inner circumferential section 52 extending between the hub 10 and the remainder of the helix 14. The inner circumferential section 52 defines a transition zone between the helix 14 and the hub 10 and includes generally curved surfaces 54 extending between the hub 10 and the upper and lower surfaces 48, 50.

These curved surfaces provide a smooth transition between the generally transverse planer surfaces 48, 50 of the helix 14 and the surface of the hub 10 which extends in a direction generally parallel to the longitudinal axis. Although it is possible to provide each of the curved surfaces 54 with a radius which remains constant in the circumferential direction of the helix 14 between the leading edge and the trailing edge, it is preferred that each of the curved surfaces defines a first radius adjacent the trailing edge 40 of the helix and a second radius adjacent the leading edge 38 of the helix, the first radius being greater than the second radius.

In this manner, additional material is added to the point of intersection between the trailing edge 40 of the helix 14 and the hub 10, and the radius gradually decreases in the circumferential direction from the trailing edge toward the leading edge 38 such that less material is used in areas expected to experience lower load stresses. In an exemplary embodiment, the radius of each of the curved surfaces 54 decreases in the circumferential direction of the helix within a region extending at least 90 degrees around the helix from the trailing edge 40, and the radius of each of the curved surfaces preferably decreases within a region extending about 180 degrees around the helix from the trailing edge.

In use, once the anchor has been installed by conventional means known in the art, the rod 22 is connected to a load, such as to a utility pole to be retained in an upright orientation by a plurality of lines extending between the pole and a number of anchors, and a tensile load is exerted on the anchor which creates a pressure acting downward on the upper surface 48 of the helix 14. This pressure acts on the helix in such a manner as to exert a relatively high load on the point of intersection between the trailing edge 40 of the helix and the hub 10. However, because the helix 14 is thickened in the region of the point of intersection, and because a smooth transition is provided between this region and adjacent areas of the helix and hub, the anchor is capable of withstanding loads which are relatively larger than loads sufficient to cause failure of an anchor lacking the localized thickening of the helix.

Although the invention has been described with reference to the attached drawing figures illustrating a preferred embodiment of the invention, equivalents may be used and substitutions made herein without departing from the scope of the invention as recited in the claims.

What is claimed is:

1. In an earth anchor apparatus including a hub having a longitudinal axis and first and second axial ends, and a load-bearing helix affixed to the hub, the load-bearing helix including a generally radially extending leading edge adjacent the first end of the hub, a generally radially extending trailing edge adjacent the second end of the hub, an inner circumferential section connected to the hub, an outer circumferential section extending radially outward from the inner circumferential section and having an outer circumferential edge separated from the inner section, and a pair of opposed surfaces extending between the inner section and the outer edge and defining a thickness of the helix, the improvement comprising:

the outer circumferential section of the helix including a thickened region adjacent the point of intersection between the trailing edge of the helix and the inner circumferential section of the helix, the thickness of the outer circumferential section of the helix decreasing in all directions away from the thickened region, the thickness of the outer circumferential section decreasing substantially continuosly in the radial direction between the thickened region and the outer circumferential edge, and circumferentially within a region extending at least 90° around the hub from the thickened region toward the leading edge; and the inner circumferential section including a generally curved surface extending between the hub and each of the opposed surfaces, each of the curved surfaces defining a first radius adjacent the trailing edge of the helix and a second radius adjacent the leading edge of the helix, the first radius being greater than the second radius.

2. The earth anchor as recited in claim 1, wherein the thickness adjacent the inner circumferential section decreases in the circumferential direction of the helix within a region extending about 180 degrees around the helix from the thickened region.

3. The earth anchor as recited in claim 1, wherein the radius of each of the curved surfaces decreases in the circumferential direction of the helix within a region extending at least 90 degrees around the helix from the trailing edge.

4. The earth anchor as recited in claim 1, wherein the radius of each of the curved surfaces decreases in the circumferential direction of the helix within a region extending about 180 degrees around the helix from the trailing edge.

* * * * *